US010815728B2

(12) United States Patent
Russell et al.

(10) Patent No.: US 10,815,728 B2
(45) Date of Patent: Oct. 27, 2020

(54) ELEVATED WORKING PLATFORM AND RELATED METHODS

(71) Applicant: Wing Enterprises, Incorporated, Springville, UT (US)

(72) Inventors: Brian Russell, Saratoga Springs, UT (US); N. Ryan Moss, Mapleton, UT (US)

(73) Assignee: WING ENTERPRISES, INCORPORATED, Springville, UT (US)

( * ) Notice: Subject to any disclaimer, the term of this patent is extended or adjusted under 35 U.S.C. 154(b) by 0 days.

(21) Appl. No.: 16/198,437

(22) Filed: Nov. 21, 2018

(65) Prior Publication Data

US 2019/0093429 A1 Mar. 28, 2019

Related U.S. Application Data

(63) Continuation of application No. 15/423,844, filed on Feb. 3, 2017, now Pat. No. 10,138,679.

(Continued)

(51) Int. Cl.

*E06C 1/393* (2006.01)
*E06C 1/16* (2006.01)

(Continued)

(52) U.S. Cl.

CPC ..... *E06C 1/393* (2013.01); *E06C 1/16* (2013.01); *E06C 1/397* (2013.01); *E06C 7/182* (2013.01); *E06C 7/185* (2013.01)

(58) Field of Classification Search

CPC . E06C 1/393; E06C 1/397; E06C 1/16; E06C 7/00; E06C 7/18; E06C 7/181;

(Continued)

(56) References Cited

U.S. PATENT DOCUMENTS 1,257,056 A * 2/1918 Wheatley ..... E06C 1/34 182/116
3,139,154 A * 6/1964 Ewald ..... E06C 7/182 182/106

(Continued)

FOREIGN PATENT DOCUMENTS

CN 103233675 B 2/2015
DE 202007000406 2/2008

(Continued)

OTHER PUBLICATIONS

Extended European Search Report for European Patent Application No. 17748238.7 dated Aug. 21, 2019.

*Primary Examiner* — Katherine W Mitchell
*Assistant Examiner* — Shiref M Mekhaeil
(74) *Attorney, Agent, or Firm* — Dorsey & Whitney LLP

(57) ABSTRACT

Elevated work platform apparatuses, as well as associated methods, are provided. In one particular embodiment, an elevated platform apparatus is provided comprising a first assembly having a pair of rails coupled with a plurality of rungs, a second assembly hingedly coupled with the first assembly, a platform pivotally coupled with the first assembly and configured to extend to, and engage a portion of, the second assembly. The apparatus further includes a cage associated with the platform. The cage may include at least one bar and at least one gate, the at least one gate being configured to swing in a first direction upon a user stepping on to the platform from the first rail assembly, and then swing back to a closed position after the user is standing on the platform. platform includes a toe-kick structure that is collapsible relative to the deck of the platform.

16 Claims, 14 Drawing Sheets

Related U.S. Application Data

(60) Provisional application No. 62/291,677, filed on Feb. 5, 2016.

(51) Int. Cl.
*E06C 1/397* (2006.01)
*E06C 7/18* (2006.01)

(58) Field of Classification Search
CPC . E06C 7/182; E06C 7/16; E06C 7/165; E06C 5/14; E06C 5/145
See application file for complete search history.

(56) References Cited

U.S. PATENT DOCUMENTS 4,214,849 A * 7/1980 Downing ..... B60P 1/4457 414/545
4,503,932 A * 3/1985 Hilton ..... E06C 7/14 182/113
4,648,481 A * 3/1987 Lee ..... A47C 12/02 182/106
5,080,192 A * 1/1992 Kerr ..... E06C 1/397 182/106
5,120,013 A * 6/1992 Sweeney ..... E06C 7/14 182/116
5,152,508 A 10/1992 Fish
5,582,268 A * 12/1996 Heberlein ..... E06C 1/393 182/113
6,328,330 B1 * 12/2001 Haaser ..... B62B 1/20 182/21
7,182,176 B2 * 2/2007 Gibson ..... A47C 12/00 182/129
8,973,707 B2 * 3/2015 Kreller ..... E04G 7/28 182/112
9,016,434 B2 * 4/2015 Moss ..... E06C 1/22 182/106
2004/0000449 A1 1/2004 Meeker
2005/0045423 A1 3/2005 Meeker
2009/0300994 A1 * 12/2009 Atkins, III ..... E04H 3/28 52/7
2011/0284325 A1 * 11/2011 Chung ..... B62B 1/12 182/129
2013/0037349 A1 * 2/2013 Vaidyaselvan ..... E06C 7/46 182/107
2013/0186710 A1 * 7/2013 Moss ..... E06C 1/393 182/104
2014/0041963 A1 * 2/2014 O'Shea ..... E06C 1/393 182/64.1
2014/0231171 A1 * 8/2014 Kerr ..... E06C 7/46 182/108
2015/0267449 A1 * 9/2015 Gill ..... E04G 5/14 160/382
2017/0241204 A1 * 8/2017 Moss ..... E06C 1/393

FOREIGN PATENT DOCUMENTS

EP 2034128 A1 3/2009
GB 2127081 A 4/1984
GB 2479202 A 10/2011
KR 20130128838 A 11/2013
KR 101379720 B1 * 3/2014 ..... B63B 9/06
KR 101379720 B1 3/2014

* cited by examiner

ELEVATED WORKING PLATFORM AND RELATED METHODS

CROSS-REFERENCE TO RELATED APPLICATIONS

The present application is a continuation of U.S. application Ser. No. 15/423,844 filed Feb. 3, 2017, entitled ELEVATED WORKING PLATFORM AND RELATED METHODS, which claims the benefit of U.S. Provisional Application No. 62/291,677 filed on Feb. 5, 2016, entitled ELEVATED WORKING PLATFORM AND RELATED METHODS, the disclosures of which are incorporated by reference herein in their entirety.

BACKGROUND

Ladders are one type of apparatus conventionally used to provide a user with improved access to elevated locations that might otherwise be difficult to reach. One of the advantages of ladders is their convenience. Ladders are easily transported from one location to another, generally easy to set up and use at a specific location, and easy and convenient to store when not in use. Ladders come in many sizes and configurations, such as straight ladders, extension ladders, stepladders, and combination step and extension ladders. So-called combination ladders may incorporate, in a single ladder, many of the benefits of multiple ladder designs.

In an effort to provide more secure, safe and stable access to elevated locations, users often employ various accessories. For example, planks or other structures are sometimes combined with two or more ladders to act as platform or scaffolding. In one particular example, so-called ladder jacks are often utilized in conjunction with a pair of ladders to provide a support for one or more wooden planks (e.g., 2 inch>10 inch planks or 2 inch×12 inch planks). Such a configuration enables a user to work on an elevated surface that exhibits a larger support surface area than that of the rung of a ladder and, thus, enables the user to work in a larger area without having to move a ladder multiple times. In another example, an attachment—sometimes referred to as a work platform—may be coupled to one or more rungs of a ladder in an effort to provide more surface area for the user to stand on, improving both their stability and comfort. However, breaking down or disassembling such a configuration, moving all of the components and then setting them up again can be time consuming and require considerable effort. Additionally, there are often no safety constraints used in such a configuration, making the use of planks a potential safety concern.

It is becoming increasingly common to require users to "tie off" or otherwise secure themselves when using a ladder or other elevating apparatus on a job site. Such a requirement may be instituted by a property owner, by an employer, or by a governmental body such as OSHA (Occupational Safety and Health Administration) to reduce the risk of injury from a fall. However, users of ladders (or other elevated support structures) sometimes find such requirements to be a nuisance and some may even try to avoid such requirements. At a minimum, users of a ladder will typically find that such requirements take additional time, making the worker less efficient at completing their task, even if they are safer while working.

It is also known that many users will often climb higher on a ladder than is recommended for the specific ladder sometimes to the highest rung of a stepladder or even on the top cap of a stepladder—even though explicit warnings are provided by the manufacturer of the ladder against such behavior. Climbing beyond the highest recommended rung can make the ladder unstable. Additionally, the user may become unstable when climbing beyond a recommended height because, for example, they may not have any additional structure to lean against or grasp with a free hand while standing at or ear the very top of the ladder.

Further, while there have been some attempts to provide solutions to the issues and concerns noted above, some proposed solutions have resulted in large apparatuses that are difficult to maneuver and pose issues in storing, transporting and shipping such apparatuses.

As such, the industry is continually looking for ways to improve the experience of using ladders and elevated platforms and to provide the users of such apparatuses with more efficient, effective, safe and comfortable experiences.

BRIEF SUMMARY OF THE INVENTION

In accordance with the present invention, various embodiments of an elevated work platform, as well as associated methods, are provided. The elevated platform may provide a relatively large surface area for a user to stand on while working at an elevated height while also providing a safe working environment without the need to continually tie-off or wear a harness during the use of the apparatus.

In accordance with one embodiment, an elevated platform apparatus is provided that includes a first assembly having a pair of rails coupled with a plurality of rungs, and a second assembly having a pair of rails, wherein the second assembly being hingedly coupled with the first assembly. The apparatus additionally includes a platform pivotally coupled to the first assembly, the platform including a deck and a toe-kick structure. The toe-kick structure includes at least one wall configured to be displaced between a first position, wherein the at least one wall extends outward from a working surface of the deck at a substantially perpendicular angle, and a second position, wherein the at least one wall is positioned substantially flat against the working surface of the deck.

In one embodiment, the first assembly and the second assembly are configured to pivot relative to each other between a deployed state and a collapsed state, wherein when the first and second assemblies are in the deployed state, the platform extends from the first assembly and engages a portion of the second assembly.

In one embodiment, the apparatus further includes a cage associated with the platform, the cage including at least one bar and at least one gate, the at least one gate being configured to swing in a first direction upon a user stepping on to the platform from the first rail assembly, and swing back to a closed position after the user is standing on the working surface of the platform, the at least one gate also being limited from being displaced in a second direction, opposite the first direction, beyond the closed position.

In one particular embodiment, the at least one gate includes a pair of gates adjacent one another.

In one embodiment, each gate of the pair includes a pivoting coupling member having an inclined engagement surface, wherein the inclined engagement surface, in conjunction with the weight of the gate, biases the gate to the closed position.

In one embodiment, the apparatus includes at least one pair of wheels coupled with the apparatus. In certain embodiments, each wheel of the at least one pair of wheels is coupled with a separate rail of the pair of rails of the second assembly.

In one embodiment, the at least one pair of wheels are pivotally coupled with the pair of rails of the second assembly such that each wheel is selectively positionable between a first position relative to the pair of rails of the second assembly and a second position relative to the pair of rails of the second assembly, wherein, when in the second position, the at least one pair of wheels are positioned substantially within a volumetric envelope defined by the pair of rails of the second assembly.

In one embodiment, the cage further includes a pair of extension members pivotally coupled with the pair of rails of the first assembly and an upper bar being pivotally coupled with the pair of extension members and also being pivotally coupled with the pair of rails of the first assembly.

In one embodiment, the cage further includes a lower bar pivotally coupled with the pair of rails of the second assembly.

In one embodiment, the apparatus further includes at least one first link member having a first end pivotally coupled with the first assembly and a second end pivotally coupled with the platform.

In one embodiment, the apparatus further includes at least one second link member having a first end pivotally coupled with the lower bar and a second end pivotally coupled with the platform.

In one embodiment, the second end of the at least one first link member and the second end of the at least one second link member share a common point of pivotal connection with the platform.

In one embodiment, the apparatus further includes a latch member associated with the at least one wall and configured to engage the at least one second link member to maintain the at least one side wall in the first position.

In one embodiment, the at least one gate is pivotally coupled with one of the pair of extension members by way of a bracket.

In one embodiment, the bracket includes a recess sized and shaped to receive a portion of one of the pair of rails of the first assembly.

In one embodiment, the at least one wall includes a first side wall, a second side wall and an end wall.

In one embodiment, the first side wall and the second side wall are formed of a substantially rigid material and are pivotally coupled with the deck.

In one embodiment, the end wall comprises a substantially collapsible material.

In one embodiment, the end wall comprises a nylon material.

In one embodiment, the end wall comprises a flexible strap.

In accordance with another embodiment, an elevated platform apparatus is provided that comprises: a first assembly having a first pair of rails coupled with a first plurality of rungs; a second assembly having a second pair of rails, the second assembly being hingedly coupled with the first assembly; a platform pivotally coupled to the first assembly; a pair of extension members, each extension member being directly pivotally coupled with an associated rail of the first pair of rails; and a bar directly pivotally coupled with each of the extension members and directly pivotally coupled with each of the first pair of rails.

In one embodiment, each of the extension members includes a first portion telescopingly coupled with a second portion.

In accordance with a further embodiment, an elevated platform apparatus is provided that comprises: a first assembly having a first pair of rails coupled with a first plurality of rungs; a second assembly having a second pair of rails, the second assembly being hingedly coupled with the first assembly; a platform pivotally coupled to the first assembly; a pair of extension members, each extension member being directly pivotally coupled with an associated rail of the first pair of rails; a first bar directly pivotally coupled with each of the extension members and directly pivotally coupled with each of the first pair of rails; a second bar directly pivotally coupled with the pair of rails of the second assembly; at least one first link member having a first end directly pivotally coupled with a portion of the first assembly and a second end directly pivotally coupled with the platform; and at least one second link member having a first end directly pivotally coupled with the second bar and a second end directly pivotally coupled with the platform.

In one embodiment, the second end of the at least one first link member and the second end of the at least one second link member share a common point of pivotal connection with the platform.

Features, aspects and acts of any of the various embodiments described herein may be combined, without limitation, with other described embodiments.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
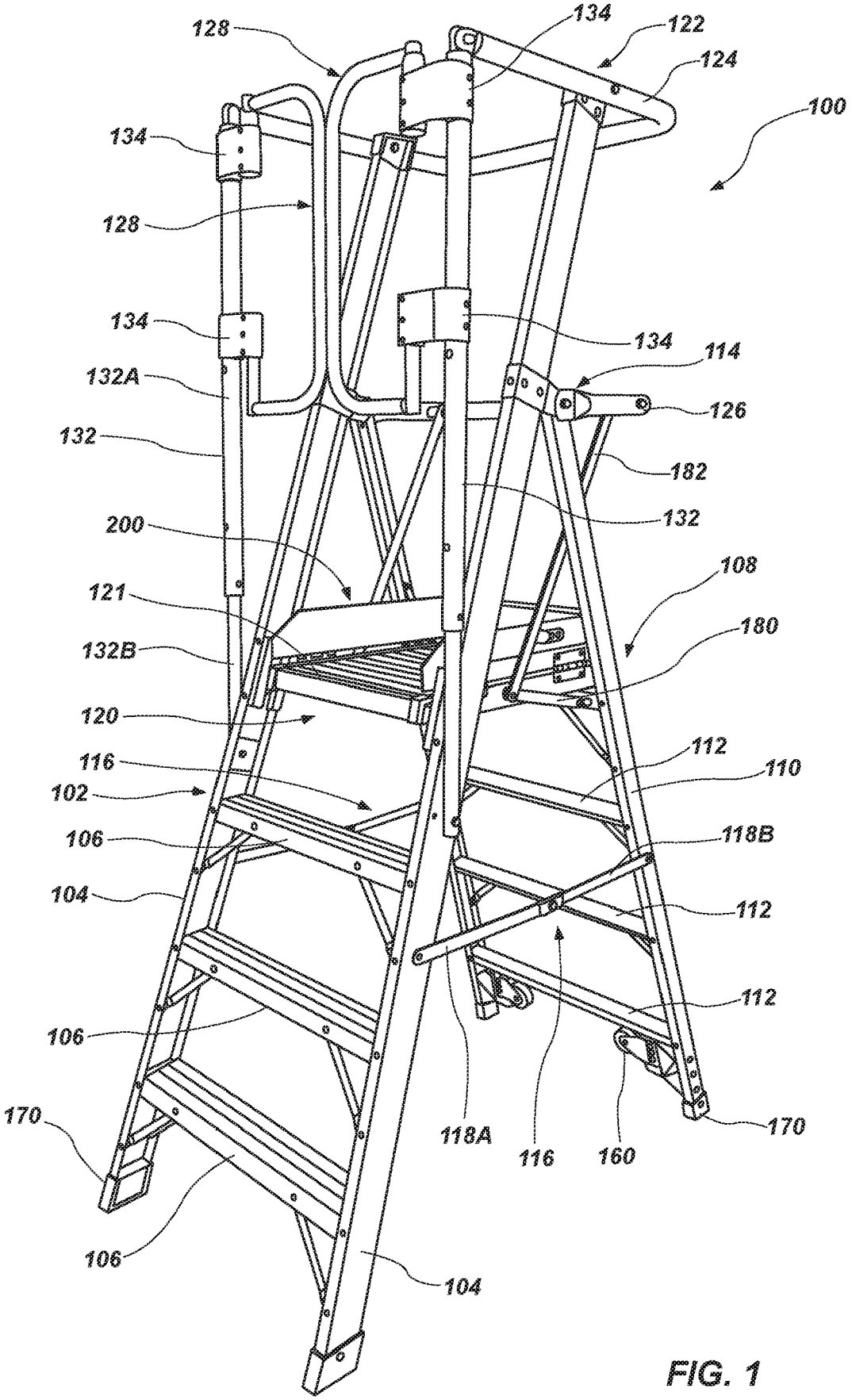
FIG. 1 is a front-side perspective view of an elevated platform apparatus in a deployed or operational state in accordance with an embodiment of the present invention.

Referring generally to FIGS. 1-6, an elevated platform apparatus 100 is shown (referred to herein as the "apparatus" for purposes of convenience). The apparatus 100 includes a first assembly 102 having a pair of spaced apart rails 104 with a plurality of rungs 106 extending between, and coupled to, the rails 104. The rungs 106 are substantially evenly spaced, parallel to one another, and are configured to be substantially level when the apparatus 100 is in an orientation for intended use, so that they may be used as "steps" for a user to ascend (or descend) the apparatus 100. While the apparatus 100 shown in drawings depicts a certain number of rungs 106 rungs, it is noted that the present apparatus 100 may be configured at a variety of heights, with any number of rungs.

Additionally, While the apparatus is shown in the drawings as a "fixed height" apparatus, in other embodiments the first assembly 102 may include "outer" and "inner" assemblies that enable the height of the apparatus 100 to be selectively adjusted. For example, such an assembly is described in U.S. Patent Publication No. US20130186710 entitled ELEVATED WORKING PLATFORM AND RELATED METHODS, published Jul. 25, 2013.

The apparatus 100 also includes a second assembly 108 having a pair of spaced apart rails 110 with a plurality of cross-braces 112 extending between, and coupled to, the spaced apart rails 110. In some embodiments, the cross-braces 112 may be configured as rungs such that rungs are accessible on both sides of the apparatus 100. Additionally, in other embodiments, the second assembly 108 may include "outer" and "inner" assemblies that enable the height of the apparatus 100 to be selectively adjusted such as noted above with respect to the first assembly 102. Additionally, it is noted that, in such embodiments, the first and second assemblies 102 and 108 may be independently adjustable such that they each may extend to varying elevations enabling the overall height of the apparatus to be selectively adjusted. In addition to the examples set forth in the previously incorporated document, such assemblies 102 and 108 may be constructed, for example, as described in U.S. Pat. No. 4,182,431, entitled COMBINATION EXTENSIONS AND STEP LADDER RUNGS THEREFOR, the disclosure of which is incorporated by reference herein in its entirety. Further, examples of adjustment mechanisms for the selective elevation or height adjustment of such assemblies are described in the aforementioned U.S. Pat. No. 4,182,431, or it may be of a different configuration. Additional examples of adjustment mechanisms and adjustable assemblies are described in U.S. Patent Application Publication No. 2009/0229918 entitled LADDERS, LADDER COMPONENTS AND RELATED METHODS, published Sep. 17, 2009, the disclosure of which is incorporated by reference herein in its entirety.

The first and second assemblies 102 and 108 may be formed of a variety of materials and using a variety of manufacturing techniques. For example, in one embodiment, the rails 104 and 110 may be formed of a composite material, such as fiberglass, while the rungs and other structural components may be formed of aluminum or an aluminum alloy. In other embodiments, the assemblies 102 and 108 (and their various components) may be formed of other materials including other composite materials, plastics, polymers, metals, metal alloys or combinations of such materials. Additionally, in various embodiments, the rungs may be coupled with their associated rails in a manner such as described in U.S. Pat. No. 7,086,499 entitled LIGHT WEIGHT LADDER SYSTEMS AND METHODS, the disclosure of which is incorporated by reference herein in its entirety. Of course, other manners of joining or coupling the rungs with the rails (and assembling of other described components) may be used as will be appreciated by those of ordinary skill in the art.

Figure 2:
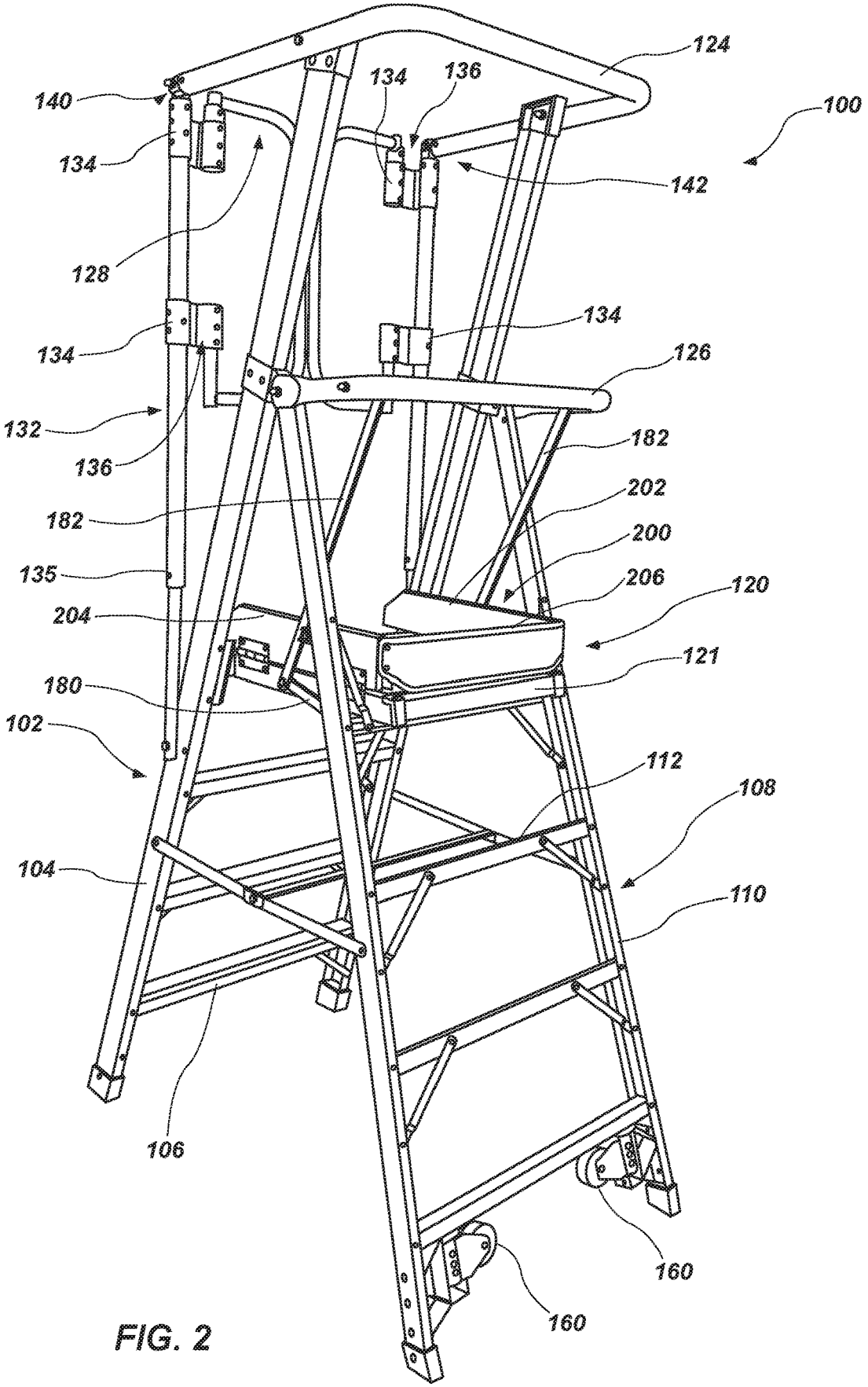
FIG. 2 is a rear-side perspective view of the elevated platform apparatus of FIG. 1 in a deployed or operational state.
Figure 3:
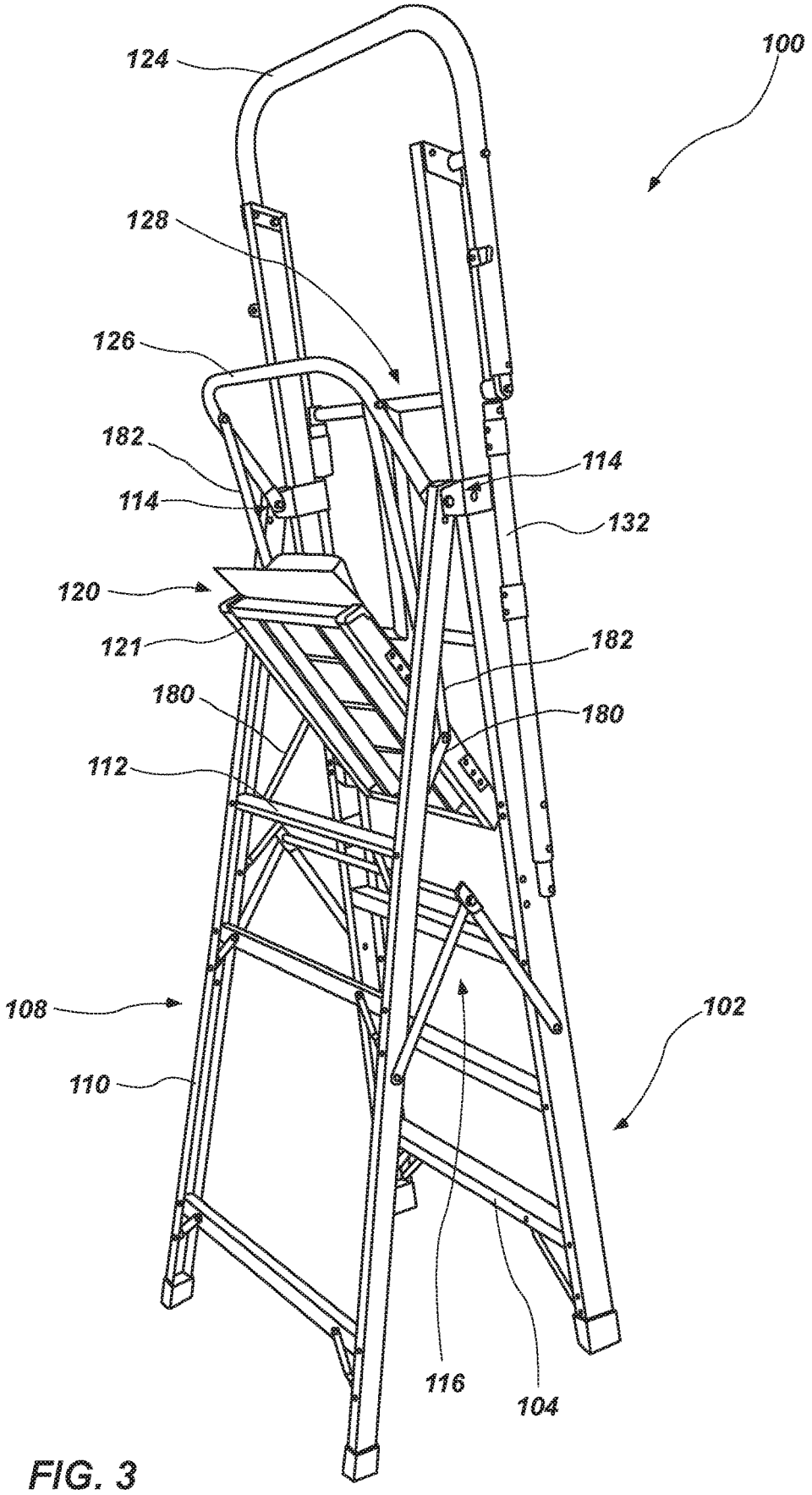
FIG. 3 is a rear-side perspective view of the elevated platform apparatus shown in FIG. 1 while the apparatus is in a partially collapsed state.
Figure 4:
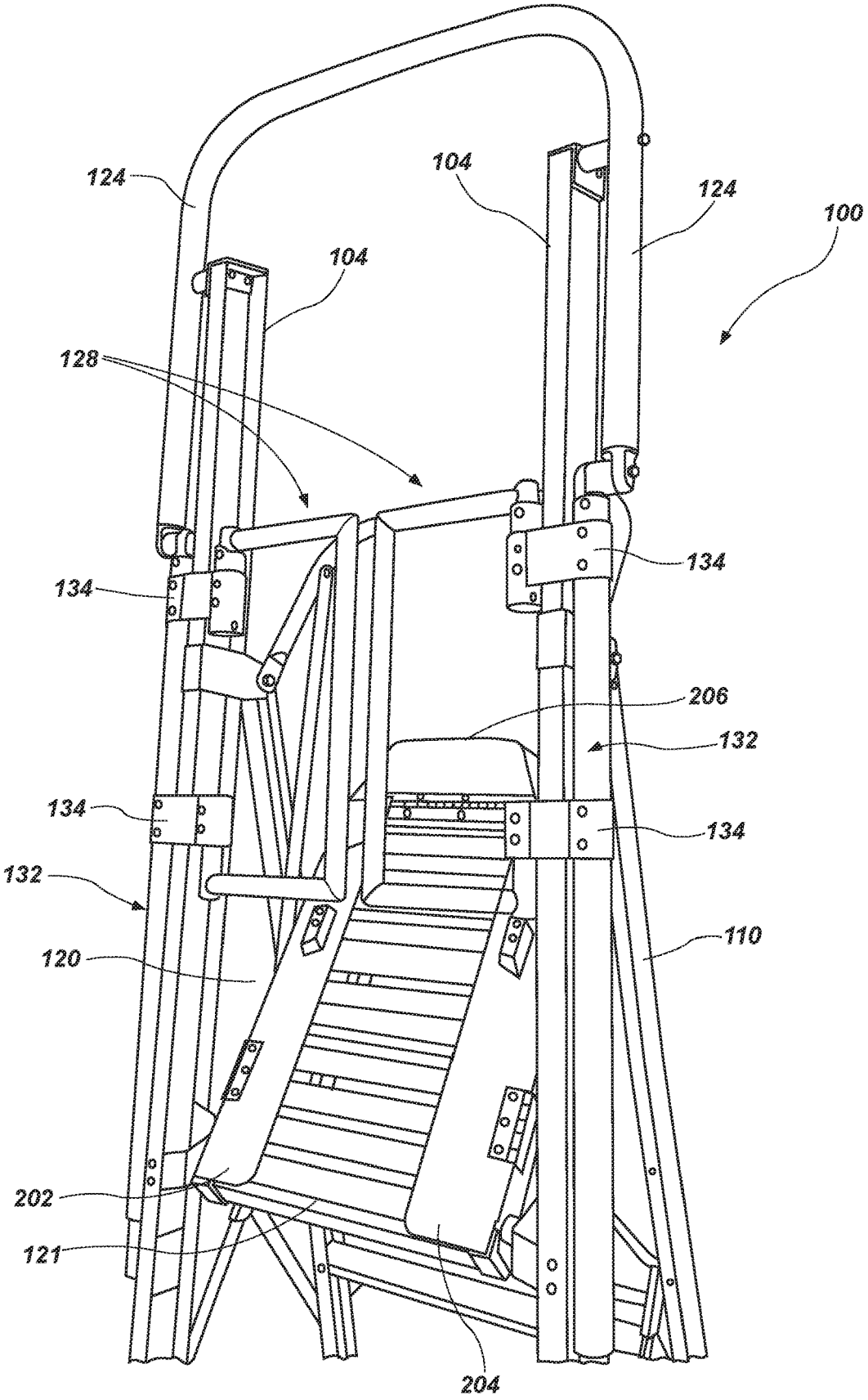
FIG. 4 is a front-side perspective view of the elevated platform apparatus shown in FIG. 1 while the apparatus is in a partially collapsed state.
Figure 5:
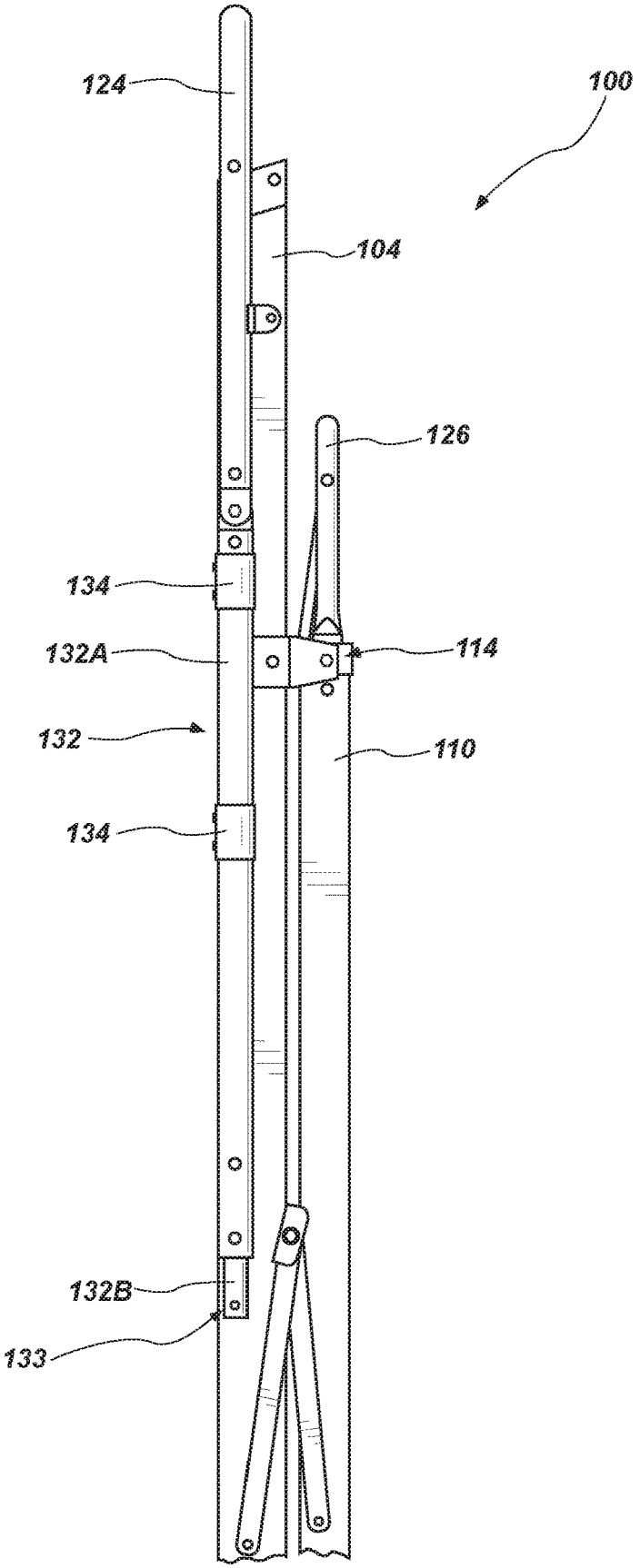
FIG. 5 is side view of the elevated platform apparatus shown in FIG. 1 while the apparatus is in a collapsed state.
Figure 6:
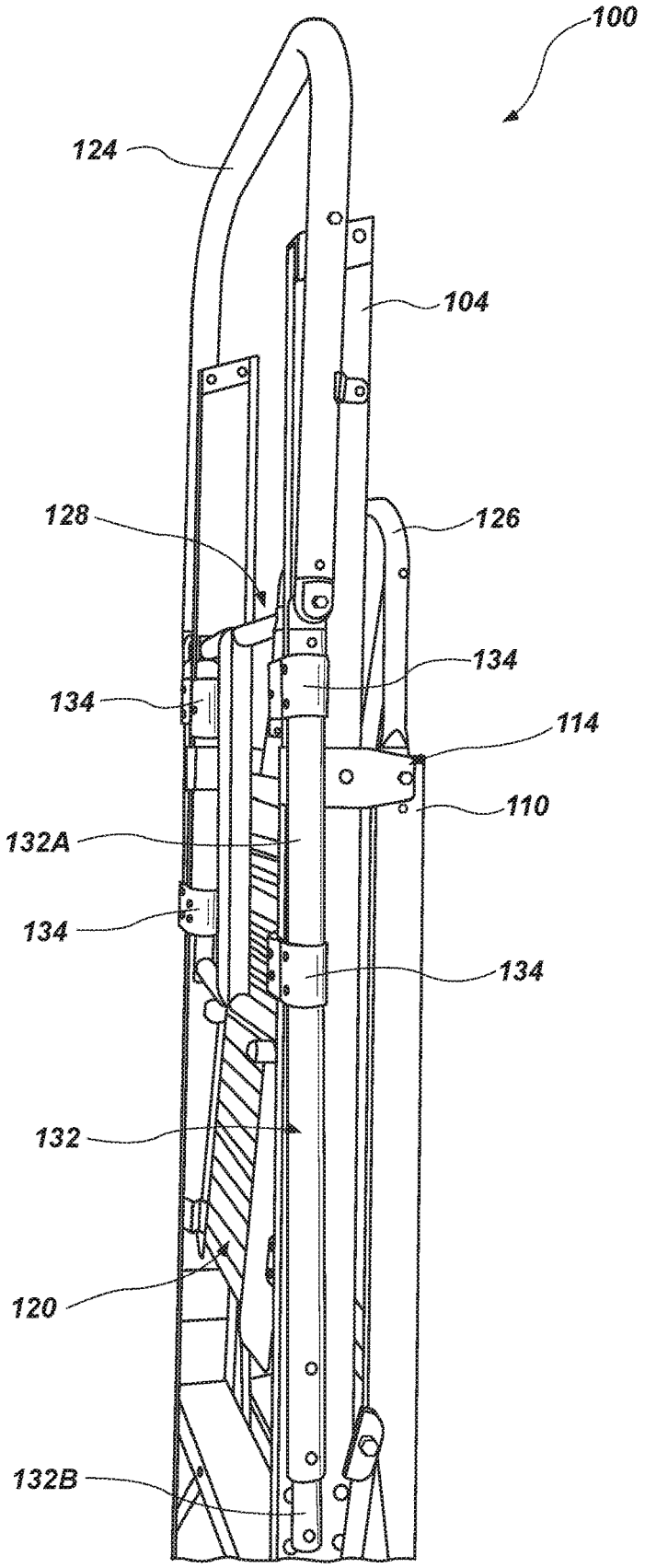
FIG. 6 is a front-side perspective view of the elevated platform apparatus shown in FIG. 1 while the apparatus is in a collapsed state.

The assemblies 102 and 108 may be pivotally coupled to one another by way of pivot brackets 114 or hinge members enabling them to extend into a deployed condition (FIGS. 1 and 2) where they are positioned such that their lower ends are spaced apart from one another (creating a stable base for the apparatus 100), and collapse into a stowed condition where their lower ends are positioned relatively close to one another (see FIGS. 5 and 6—with FIGS. 3 and 4 showing a transition between the deployed and collapsed states or conditions). The stowed state of the apparatus, and the transition between stowed and deployed states, will be discussed in further detail below. Further, a pair of spreaders 116 extend between the rails 104 and 110 of the two assemblies 102 and 108. The spreaders include individual members 118A and 118B that are pivotally coupled with each other and also each having ends that are coupled with an associated rail (e.g. one with a rail 104 of the first assembly 102 and one with a rail 110 of the second assembly). As will be appreciated by those of ordinary skill in the art, the spreaders 116 enable the first and second assemblies 102 and 108 to be locked in a deployed condition.

A platform 120 is associated with the rail assemblies 102 and 108. The platform 120 is pivotally coupled with the first assembly 102 (e.g., with the rails 104 of the first assembly) and may rest on cross-bracing 112 or other structural members of the second assembly 108 when the apparatus 100 is in a deployed condition (see FIG. 1). In one embodiment, the platform 120 may simply rest on, and be supported by, a cross-brace 112 of the second assembly 108. In other embodiments, a latch or locking mechanism may be used to selectively lock the platform 120 in a deployed state (e.g., such as shown in FIGS. 1 and 2). When in the working or deployed state, the platform 120 provides an enlarged area or support surface for a worker to stand on comfortably and safely so that they can work at the highest support position of the apparatus 100. The platform includes a deck 121 having a working surface (i.e., the surface on which a user stands during use of the apparatus 100) and a toe-kick structure 200 which shall be discussed in further detail below.

A safety enclosure, referred to herein as a cage 122, may be spatially formed about the platform to encompass a worker while standing on the platform 120. When designed appropriately, the provision of a cage 122 may preclude the necessity of a worker needing to wear a harness and "tie off" while working on the apparatus 100. The cage 122 may include a first bar 124 positioned at a first elevation that extends around most (e.g., three sides) of the perimeter of the work space situated above, and generally defined by the platform 120. The cage 122 may also include a second bar 124 positioned at a second (higher) elevation that extends around most of the perimeter of the work space situated above and defined by the platform 120. One or more gates 128 may be located on one side of the cage 122 and configured to enable a user to climb the first assembly 102 and pass through the gates 128 with the gates 128 closing behind the user as he or she stands on the platform 120. A number of components of the cage 122 may be coupled together using hinges or pivoting joints enabling them to be deployed, as shown in FIGS. 1 and 2, and collapsed as indicated in FIGS. 5 and 6. For example, the upper bar 124 may be pivotally or hingedly coupled with extension members 132 that are, in turn, pivotally coupled with the first assembly 102 (e.g., bottom terminal end 133 of lower bar 132B may be pivotally coupled with the rails 104 as shown in FIG. 5). The upper bar 124 may additionally be pivotally coupled with rails 104 of the first assembly 102 (e.g., coupled with the upper portions of the rails 104).

In the embodiment shown, the lower bar 126 is pivotally coupled to the same pivot brackets 114 to which the second assembly 102 is pivotally coupled. Additionally, the gates 128 are hingedly or pivotally coupled to the extension members 132 by way of a bracket 134 that is configured for to enable the apparatus to be compactly stowed or collapsed as will be discussed further below.

The gates 128 may be configured, for example, to swing or pivot inwardly as the user passes through them and steps from the rungs 106 of the first assembly 102 to the platform 120, automatically swing back to the position shown in FIG. 1 (e.g., through the use of springs or other biasing mechanisms or actuators), and then resist any force applied to it in an outward direction to prevent a user from inadvertently stepping back through the gates 128 and falling from the platform 120. To exit the cage 122, a user may pull the gates 128 inwardly and pass through them from the platform 120 to the rungs 106 of the first assembly 102 and then descend from the platform 120. Examples of self-returning gates are described in the previously incorporated U.S. Patent Publication No. US20110186710. Of course other mechanisms, including various springs or spring biased hinges, may be used in association with the gates as will be appreciated by those of ordinary skill in the art.

Still referring to FIGS. 1-6, the upper bar 124 may be positioned at a height, for example, that is between the waist height and the chest height of an average user (e.g., between approximately 3 feet and 5 feet above the platform 120). In one embodiment, the height of the upper bar 124 (as well as the lower bar(s) 126) may be adjustable to accommodate users of varying heights. In such a case, a minimum height may be defined per relevant safety standards or in accordance with appropriate design considerations. Additionally, in one embodiment, either or both of the bars 124 and 126 may provide an enlarged spatial perimeter as compared to the perimeter of the platform 120 such that the volume defined by the cage 122 is larger than just the volume that would be defined by the perimeter of the platform 120 extended vertically upwards. In other words, while a user may be able to stand on a relatively small surface area, the rest of the user's body may need more space to move about, especially if the user is wearing a tool belt or carrying other equipment needed to accomplish their task.

Stated another way, the perimeter of the upper portion of the cage (such as may be defined by tracing a path starting at a first end 140 of the upper bar 124, following the upper bar 124 around to its second end 142, and then across the gates 128 back to the first end 140 of the upper bar 124) is larger than the perimeter of the platform 120. Similarly, the area bound by the perimeter of the upper portion of the cage 122 in such an embodiment is larger than the area that is bound by the perimeter of the platform 120.

While not specifically shown in the drawings, the cage 122 may include netting or other components to further confine a user within the cage 122. For example, a flexible barrier may include netting extending generally between the platform 120 and the lower bar 126 and may extend about the sides of the cage 122 while not impeding the entrance through the gates 128. The flexible barrier may provide additional security in preventing a user from placing a foot or leg through the space defined between the platform 120 and the lower bar 126. If desired, such a flexible barrier 144 may be extended further, for example, up to the upper bar 124.

Figure 7:
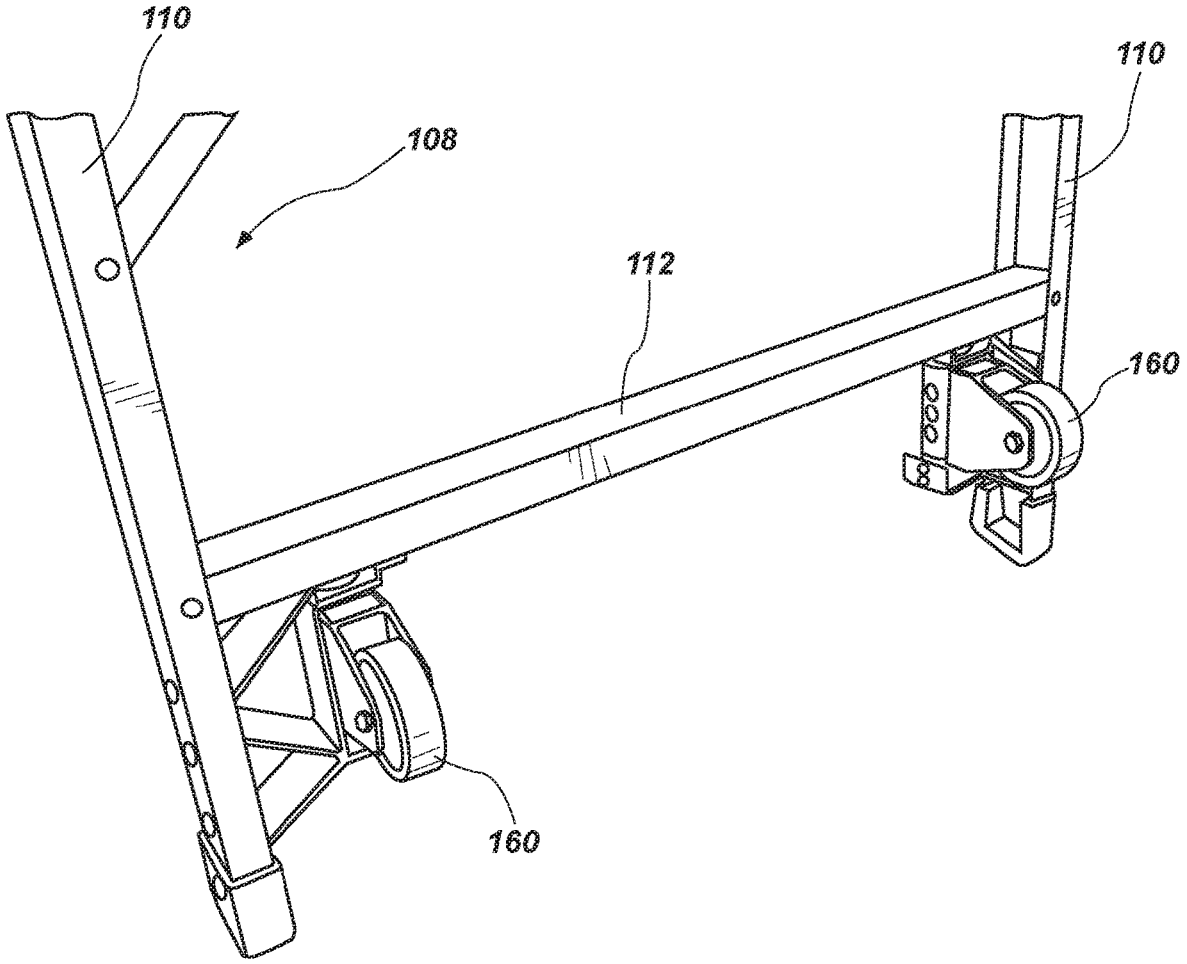
FIG. 7 shows details of certain components of the elevated platform apparatus shown in FIG. 1.
Figure 8:
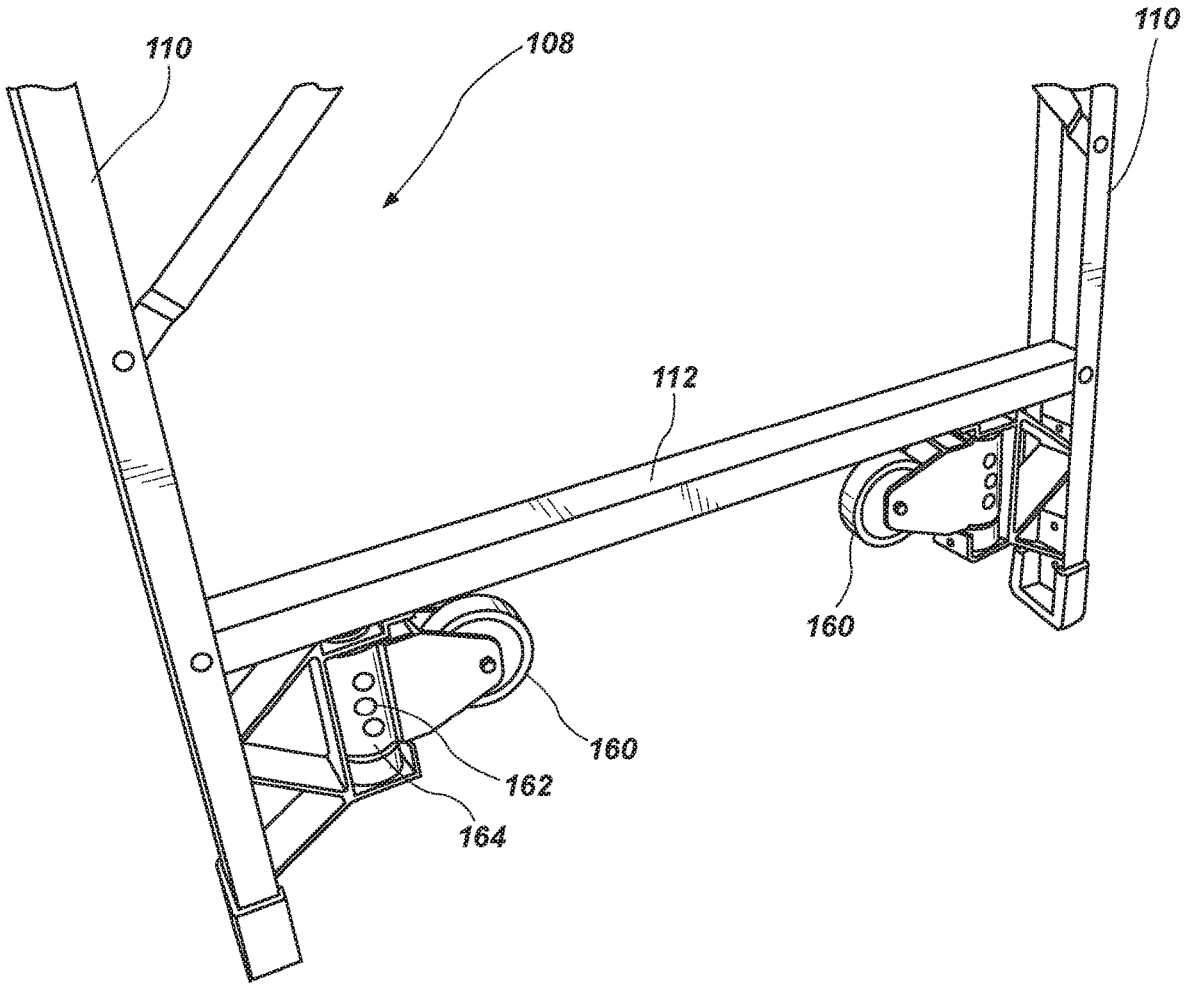
FIG. 8 shows further details of additional components of the elevated platform apparatus shown in FIG. 1.

The apparatus 100 may further include wheels 160 associated with either or both of the assemblies 102 and 108. In one embodiment, as seen in FIGS. 1 and 2, a first set of wheels 160 may be coupled with the second assembly 108 at a fixed location and be configured such that they do not touch the ground when the apparatus 100 is in a deployed condition as shown in FIG. 1. Further, as seen in FIGS. 7 and 8, the wheels 160 may be pivotally coupled to the rails 110 of the second assembly 108 and pivot between a first, deployed position (as seen in FIG. 7) and a stowed or non-deployed state (as seen in FIG. 8 as well as FIGS. 1 and 2). When the apparatus 100 is in a deployed condition, the wheels 160 do not contact the ground or supporting surface regardless of which position the wheels are in as can be seen in both FIGS. 7 and 8. However, when in the wheels 160 are in the deployed state (FIG. 7), the wheels 160 may engage the ground when the apparatus 100 is collapsed (FIGS. 5 and 6) and then tilted beyond a given angle. This enables the wheels 160 to be used to roll the apparatus (e.g., such as by being dragged or pushed by a user) when the apparatus 100 is in a collapsed state, while preventing the apparatus 100 from rolling on the wheels 160 when it is in a deployed condition. The wheels may further be configured to be locked in the deployed state (FIG. 7), the stowed or retracted state (FIG. 8), or both. For example, in one embodiment, a spring biased button may be associated with a shaft which engages one of the openings 162 of a collar 164 or tube disposed about the shaft. Thus, as the wheel 160 and collar 164 turn relative to the shaft, the push button will extend through the opening 162 in the collar when aligned therewith, preventing the wheel 160 and collar 164 from further rotation. Of course other types of locks may also be used as will be appreciated by those of ordinary skill in the art.

Further, the ability to move the wheels 160 to the stowed position (FIGS. 1, 2 and 8) enable the wheels 160 to be placed substantially within a volumetric envelope defined by the outer surfaces of the rails 110 of the second assembly 108. The ability to position the wheels 160 within this envelope provides a variety of advantages. For example, keeping the wheels 160 within the defined envelope makes the apparatus smaller for purposes of transportation and storage. Additionally, keeping the wheels 160 within the defined envelope helps to protect the wheels from inadvertent damage (e.g., during transportation) when the wheels are not needed by the user to roll the apparatus from location to another.

In other embodiments, other wheel arrangements may be used including those described in the previously incorporated U.S. Patent Publication No. US20110186710. For example, wheels may be coupled the apparatus with one wheel coupled to, or located adjacent, the lower end of each rail. In one particular embodiment, the wheels may be constructed with a biasing element that, when subjected to only the weight of the apparatus 100, enables the wheels to be deployed such that the apparatus may be rolled from one position to another, while, when a user climbs onto the apparatus 100, the additional weight of the user causes the wheels to retract so that the feet (or lowermost portions of the rails) of the apparatus 100 engage the ground and stabilize the apparatus 100.

As seen in the drawings, the apparatus may further include feet 170 coupled to the bottom of the rails (104 and 110) that have appropriate engagement surfaces associated therewith to provide the apparatus 100 with the desired friction and stability when placed on a supporting surface. Iii one embodiment, the feet 170 may be configured to "snap-on" to the associated rail. For example, the feet 170 may be manufactured and assembled as described in U.S. Pat. No. 9,016,434 entitled LADDERS, LADDER COMPONENTS AND RELATED METHODS issued on Apr. 28, 2015. In one embodiment, wheels may be combined with the feet in a manner such as described in U.S. Pat. No. 9,016,434.

With continued reference to FIGS. 1-5, the platform 120 has a first end pivotally coupled with the first assembly 102. (e.g., directly pivotally coupled with the rails 104). It is noted that "directly coupled" as used herein contemplates the use of appropriate hardware, such as a bracket.

A first set of link members 180 have one end pivotally coupled with the second assembly 108 (e.g., directly pivotally coupled with the cross members 112 or the rails 110) and a second end directly pivotally coupled with the platform 120. A second set of link members 182 have a first end directly pivotally coupled with the lower bar 126 and have a second end directly pivotally coupled with the platform 120. As seen, for example, in FIG. 3, the second ends of the first link members 180 and the second ends of the second link members 182 may be pivotally coupled with the platform at common pivot points (e.g., they may share a common pivot member). Thus, when the apparatus 100 is transitioning between states (e.g., from a deployed state to a stowed or collapsed state), as the second assembly 180 pivots towards first assembly 102, the first link members 108 push the platform 120 upwards such that it pivots relative to the first assembly 102 (see, e.g., FIG. 3). In response to the first link members 180 pushing upwards, the second link members 182 similarly push upwards on the lower bar 126, causing the lower bar 126 to also pivot upwards relative to the first assembly 102 (see, e.g., FIG. 3).

When the apparatus 100 is placed in the stowed or collapsed state, the lower bar 126 pivots such that it becomes positioned adjacent to, and extends substantially parallel to, the rails 104 of the first assembly 102 as seen in FIGS. 5 and 6. Further, when the apparatus 100 is in the stowed or collapsed state, the platform 120 is substantially positioned within a volumetric envelope that is defined by both the side rails 104 of the first assembly 102 and the side rails 110 of the second assembly 108.

Figure 9:
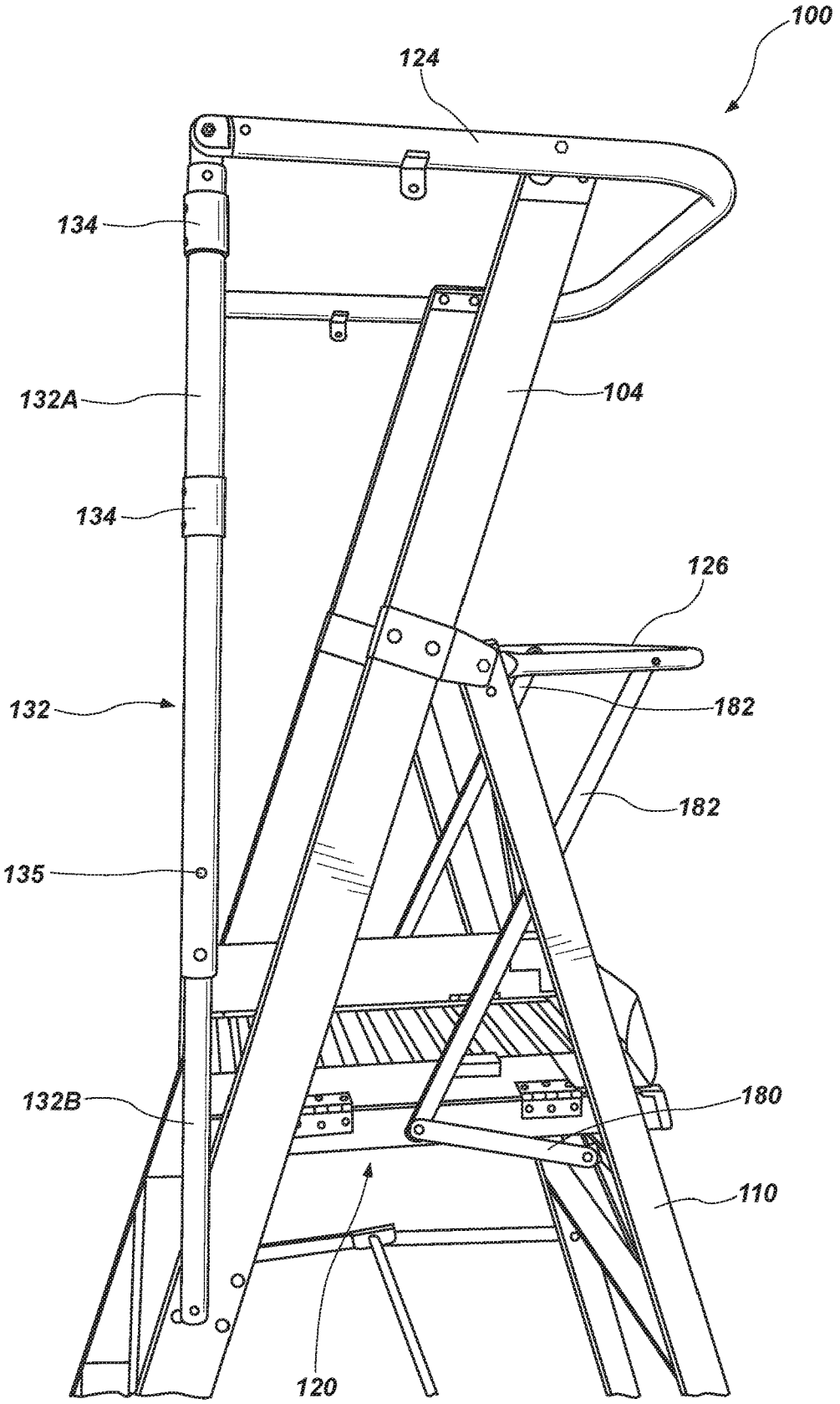
FIG. 9 shows an upper portion of the elevated platform apparatus shown in FIG. 1.
Figure 10:
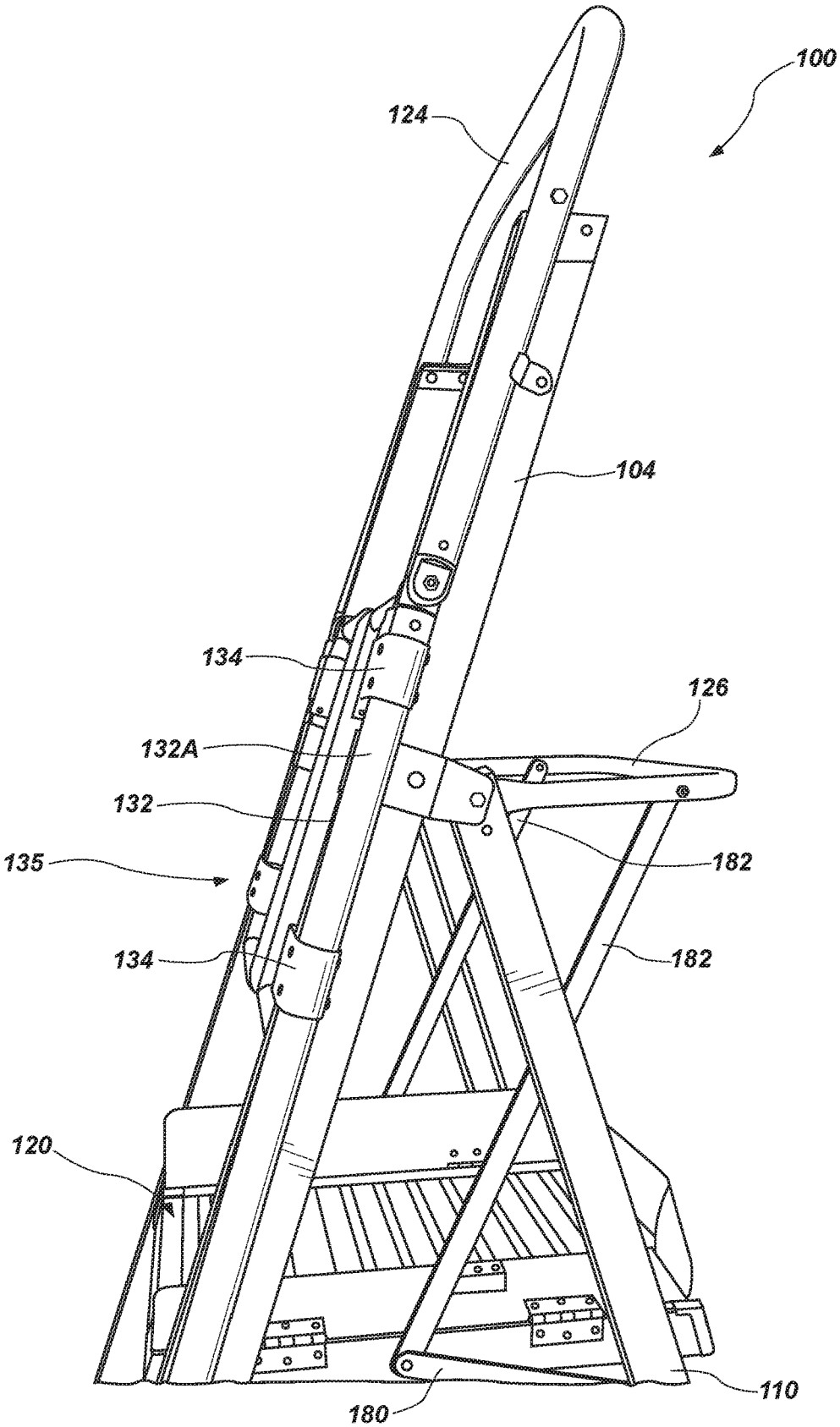
FIG. 10 shows an upper portion of the elevated platform shown in FIG. 1, with a restraint portion in a collapsed or stowed state according to an embodiment of the invention.

In addition to pivoting the first and second assemblies 102 and 108 relative to each other in transitioning the apparatus 100 from a deployed state to a stowed state, the extension members 132 may be retracted causing the upper bar 124 to pivot relative to the first assembly 102. For example, referring to FIGS. 9 and 10, the extension members 132 may include a locking member 135 such as a spring biased button (similar to that described above with respect to the wheels), a detent mechanism or other appropriate locking mechanism that holds the extension members in the deployed state (see FIG. 9) until actuated. When the locking member 135 is actuated by a user (i.e., placed in a released or non-locked state), the extension members may collapse in a telescoping fashion (for example, an upper portion 132A, also referred to as second member, may slide over and collapse relative to a lower portion 132B, also referred to as first member) until in a stowed or collapsed state (FIG. 10). If desired, a locking member may also be associated with the extension members to keep them in the collapsed state as well. When the extension members 132 collapse, their pivotal connection with the upper bar 124 causes the upper bar 124 to pivot relative to the first assembly 102 such that the upper bar 124 extends generally in a direction that is substantially parallel to the rails 104 of the first assembly 102 when in the collapsed or stowed state.

Figure 11:
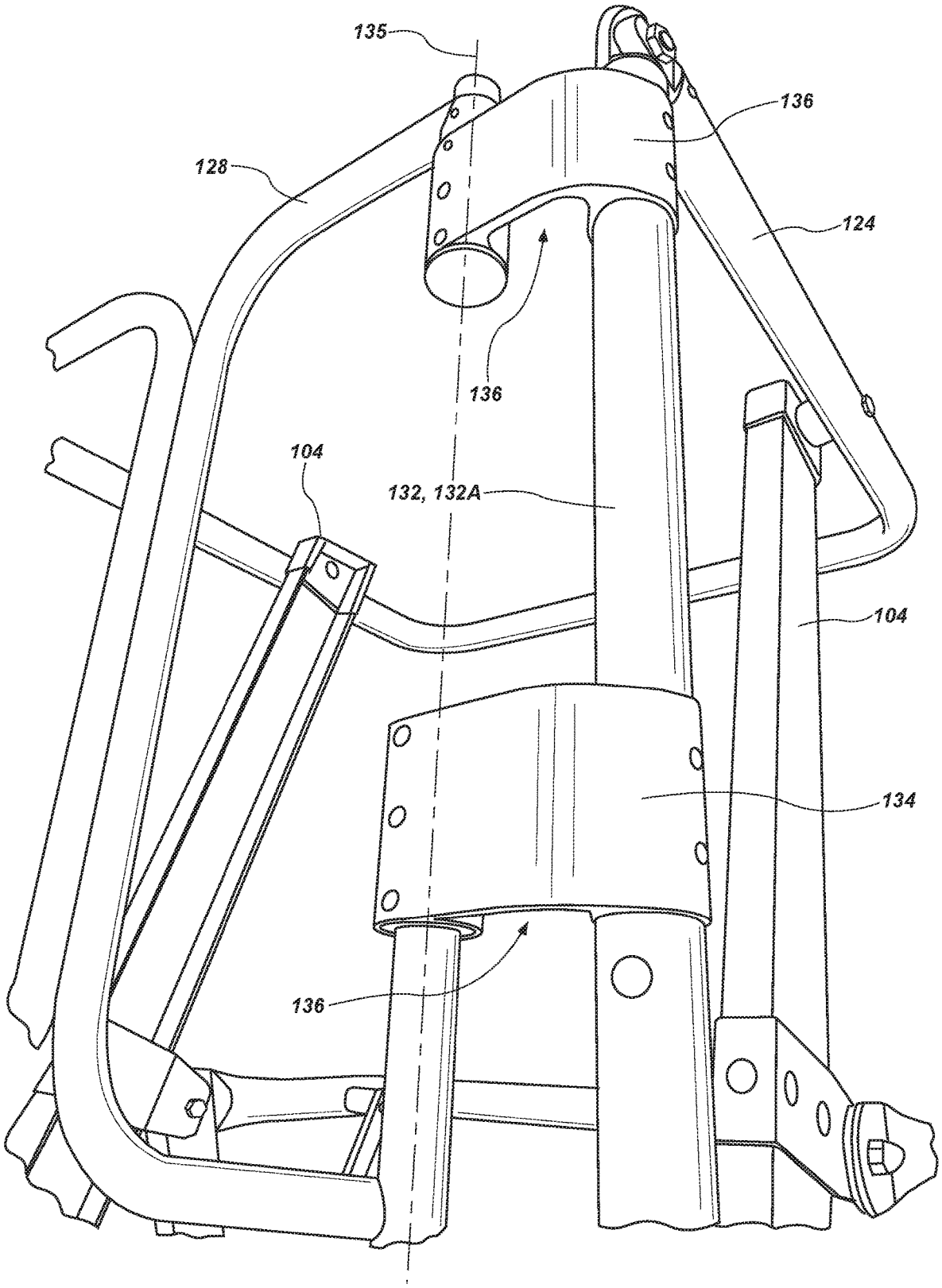
FIG. 11 shows details of further components of the elevated platform apparatus shown in FIG. 1.

Referring briefly to FIG. 11, it is noted that the brackets 134 that couple the gates 128 to the extension members 132 are each configured with a recess 136 to conformally receive portions of the rails 104 of the first assembly with the extension members 132 and upper bar 124 are placed in a collapsed state. This configuration spaces the pivot axis 135 of the gates 128 laterally inwardly from extension members 132. The recess 136 formed in the bracket 134 enables the extension members 132 and the sides of the upper bar 124 to be positioned along the outer sides of the rails 104 of the second assembly when in a collapsed state. Further, the recessed brackets 134 enable the gates 128 to be positioned substantially within a volumetric envelope defined by the rails 104 of the first assembly 102. Thus, such an arrangement provides for a substantially reduced volumetric profile of the apparatus 100 when in a collapsed or stowed state (see, FIGS. 5, 6 and 10).

Figure 12:
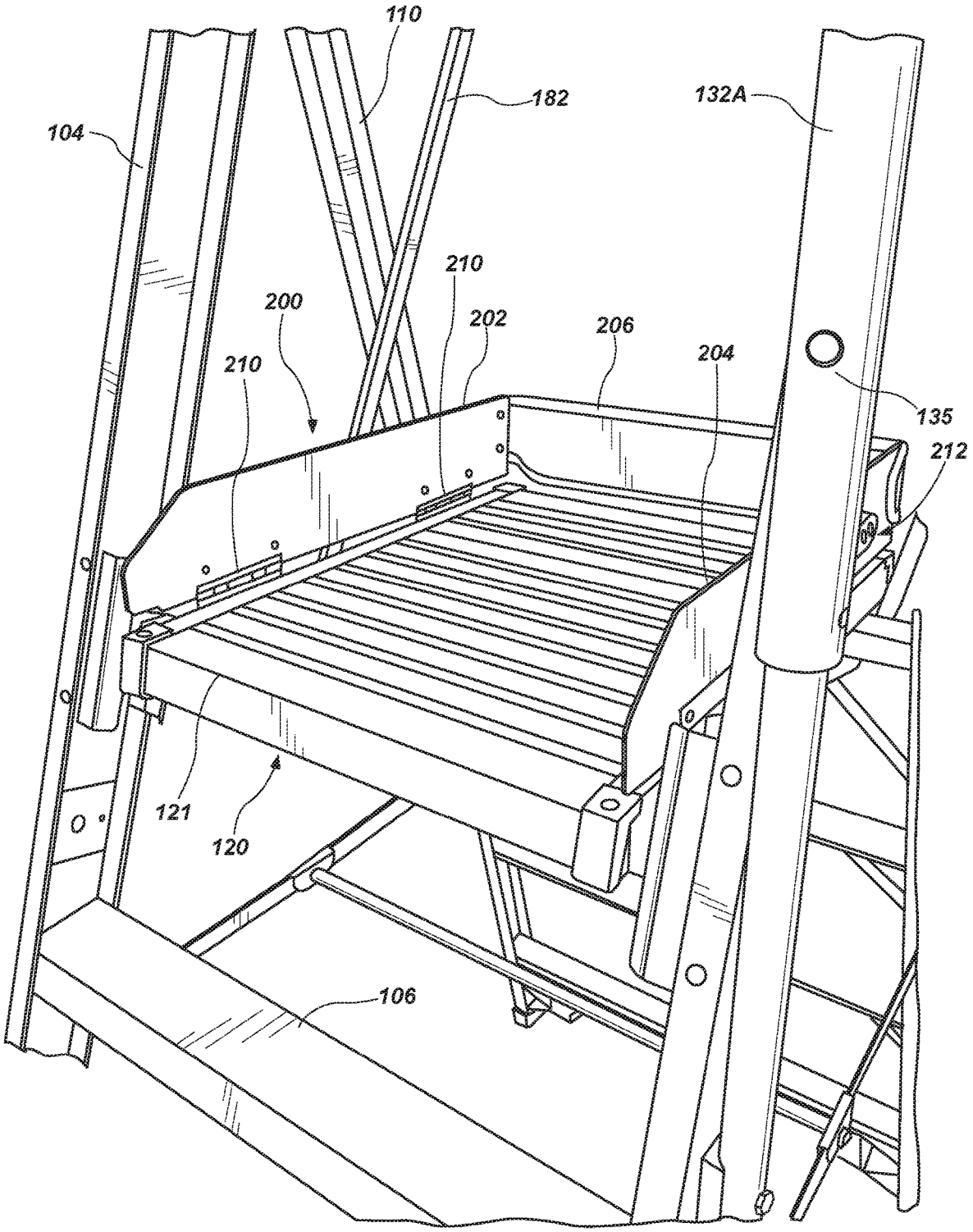
FIG. 12 shows additional details of certain components of the elevated platform apparatus shown in FIG. 1.

Referring now to FIG. 12, with additional reference to FIGS. 1 and 2, the platform 120 also includes a toe-kick structure 200 along three sides thereof and extending upwards from the working surface or deck 121 of the platform 120. The toe-kick structure 200 includes a first side wall 202, a second side wall 204 and an end wall 206. In one embodiment, the side walls 202 and 204 may be formed of a relatively rigid material such as aluminum (or other metals or metal alloys), a plastic material, or composite material (e.g., fiberglass). Additionally, in one embodiment, the end wall 206 may be formed of a relatively non-rigid material such as a flexible plastic sheet, mesh, nylon, or a fabric type material which is easily collapsible (e.g., the material exhibits little if any strength in compression while exhibiting good strength in tension).

Figure 13:
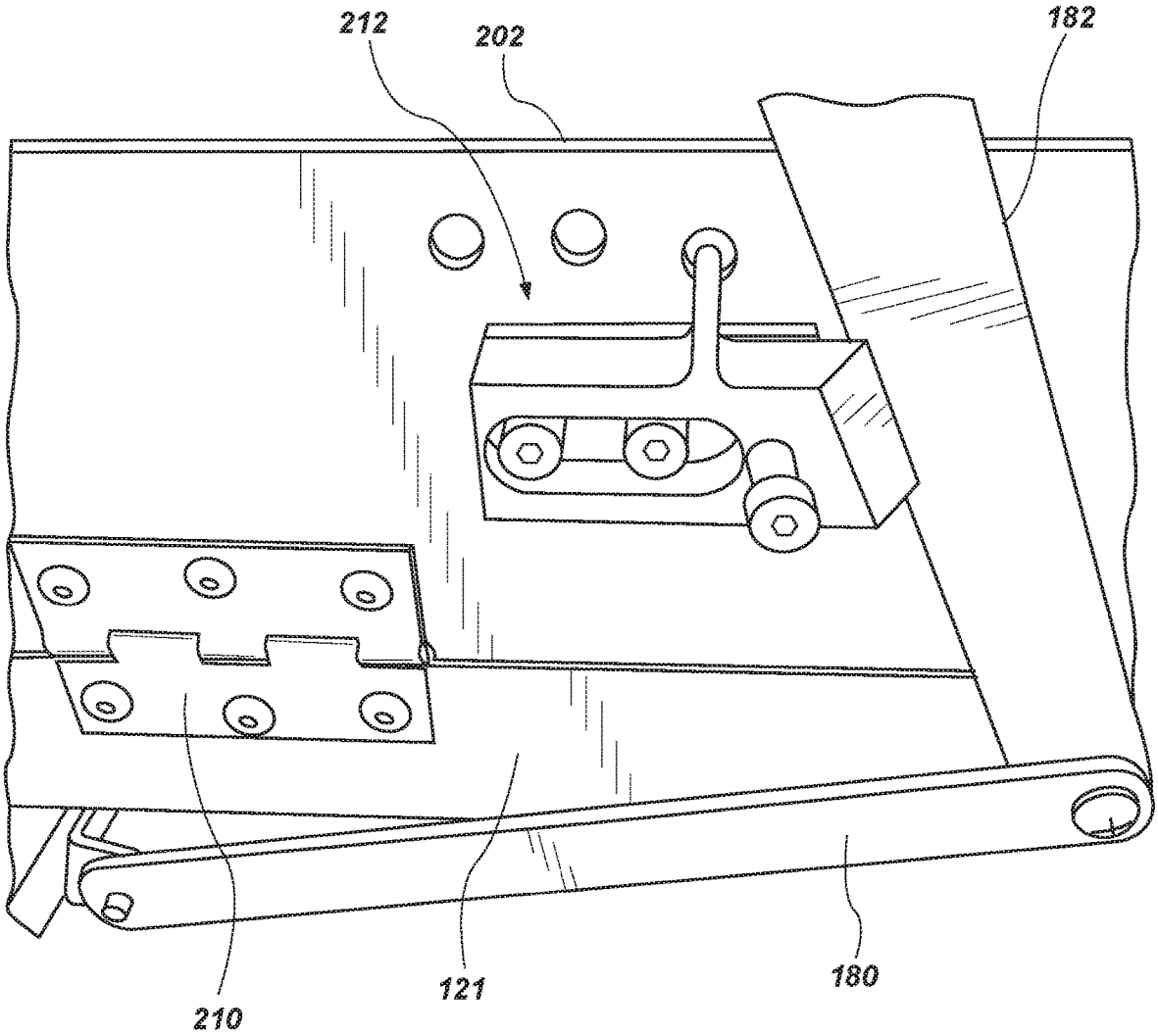
FIG. 13 shows additional details of certain components of the elevated platform apparatus shown in FIG. 1.

As seen in FIG. 13, the side walls 202 and 204 may be coupled with the platform 120 by way of one or more hinges 210. When the side walls are positioned such as shown in FIG. 12, a lock or latch member 212 may cooperate with another member, such as the second link member 182, to maintain the side walls 202 and 204 in the deployed, upright state. Additionally, when the side walls 202 and 204 are in the deployed state such as shown in FIG. 12, the end wall 206 is pulled taut between the two side walls 202 and 204 to place the end wall in a deployed state.

Figure 14:
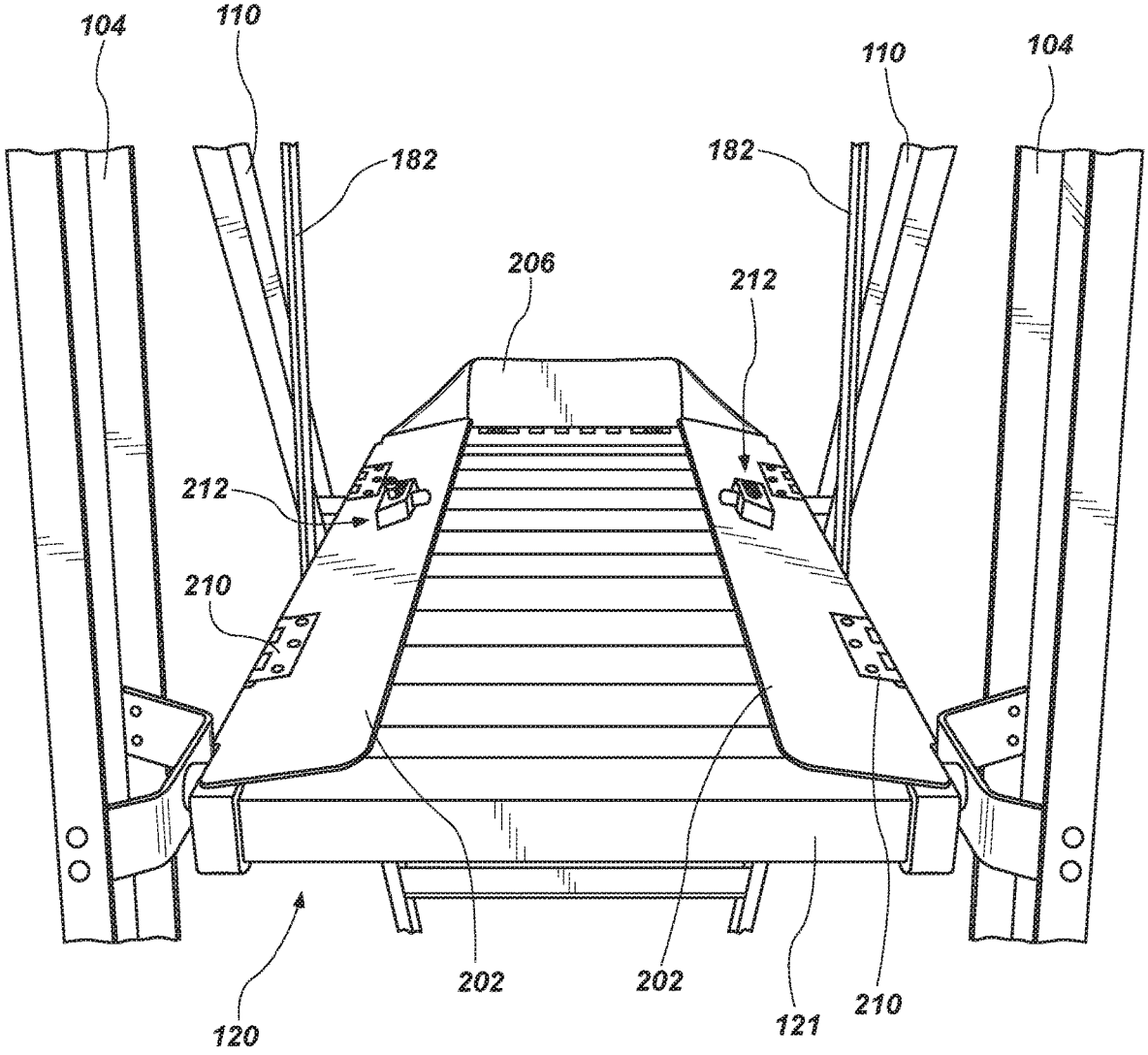
FIG. 14 shows details of additional components of the elevated platform apparatus shown in FIG. 1.

The side walls 202 and 204 may be unlatched and pivoted to a collapsed or stowed state such as shown in FIG. 14, placing the side walls substantially flat against the working surface of the platform 120. When the side walls 202 and 204 are collapsed, the end wall 206 also collapses or folds down (due to the nature of the material used to form the end wall 206) such that the toe-kick structure 200 takes up very little space when the apparatus 100 is in a collapsed state. In one embodiment, the collapse of the toe-kick structure 200 enables the whole platform 120 to remain positioned substantially within the volumetric envelope defined by the rails 104 of the first assembly when the apparatus 100 is in the stowed or collapsed state.

It is noted that, in other embodiments, the end wall 206 may be formed of a material similar to the end walls (e.g., an aluminum material). In such an embodiment, the end wall 206 may be hingedly coupled with the platform 120, in a manner similar to the side walls 202 and 204, still providing the toe-kick structure with the ability to collapse on top of the working surface of the platform 120.

While the invention may be susceptible to various modifications and alternative forms, specific embodiments have been shown by way of example in the drawings and have been described in detail herein. However, features, aspects and acts of any of the various embodiments described herein may be combined, without limitation, with other described embodiments. Additionally, it should be understood that the invention is not intended to be limited to the particular forms disclosed. Rather, the invention includes all modifications, equivalents, and alternatives falling within the spirit and scope of the invention as defined by the following appended claims.

What is claimed is:

1. An elevated platform apparatus comprising:

a first assembly having a pair of rails coupled with a plurality of rungs;

a second assembly having a pair of rails, wherein the first assembly and the second assembly are configured to pivot relative to each other about at least one hinge member between a deployed state and a collapsed state;

a platform pivotally coupled to the first assembly, wherein when the first and second assemblies are in the deployed state, the platform extends from the first assembly and engages a portion of the second assembly;

a cage associated with the platform, the cage including:

a pair of extension members, each extension member including a first member and a second member telescopingly coupled with the first member, the first member having a bottom terminal end, the bottom terminal end of the first member being pivotally coupled with an associated rail of the pair of rails of the first assembly, an upper bar pivotally coupled with the pair of extension members and also pivotally coupled with the pair of rails of the first assembly, a lower bar pivotally coupled with the pair of rails of the second assembly, at least one gate coupled with at least one of the pair of extension members;

at least one first link member having a first end pivotally coupled with the second assembly and a second end pivotally coupled with the platform;

at least one second link member having a first end pivotally coupled with the lower bar and a second end pivotally coupled with the platform, wherein the second end of the at least one first link member and the second end of the at least one second link member share a common point of pivotal connection with the platform.

2. The apparatus of claim 1, wherein the platform includes a deck and a toe-kick structure, the toe-kick structure including at least one wall configured to be displaced between a first position, wherein the at least one wall extends outward from a working surface of the deck at a substantially perpendicular angle, and a second position, wherein the at least one wall is positioned substantially flat against the working surface of the deck.

3. The apparatus of claim 2, further comprising a locking mechanism configured to maintain the at least one side wall in the first position.

4. The apparatus of claim 3, wherein the locking mechanism includes a latch member associated with the at least one wall and configured to engage the at least one second link member.

5. The apparatus of claim 2, wherein the at least one wall includes a first side wall, a second side wall and an end wall.

6. The apparatus of claim 5, wherein the first side wall and the second side wall are formed of a substantially rigid material and are pivotally coupled with the deck.

7. The apparatus of claim 6, wherein the end wall comprises a foldable material.

8. The apparatus of claim 7, wherein the end wall comprises nylon.

9. The apparatus of claim 1, wherein each of the pair of extension members exhibit a first length when the first assembly and the second assembly are placed in the collapsed state and exhibit a second length with the first assembly and second assembly are placed in the deployed state, the first length being shorter than the second length.

10. The apparatus of claim 1, wherein the at least gate is configured to swing in a first rotational direction from a closed position to an open position, the at least one gate being limited from being displaced in a second rotational direction, opposite the first rotational direction, beyond the closed position.

11. The apparatus of claim 10, wherein the at least one gate includes a pair of gates adjacent one another.

12. The apparatus of claim 1, further comprising at least one pair of wheels coupled with the apparatus.

13. The apparatus of claim 12, wherein each wheel of the at least one pair of wheels is coupled with an associated rail of the pair of rails of the second assembly.

14. The apparatus of claim 13, wherein each wheel of the at least one pair of wheels is pivotally coupled with its associated rail such that each wheel is selectively positionable between a first position relative to its associated rail and a second position relative to its associated rail, wherein, when in the second position, the at least one pair of wheels are positioned substantially within a volumetric envelope defined by the pair of rails of the second assembly.

15. The apparatus of claim 1, wherein, when the first assembly and the second assembly are in the collapsed state, the pair of extension members and the upper bar extend in a substantially common plane.

16. The apparatus of claim 15, wherein when the first assembly and the second assembly are in the collapsed state, the upper bar extends beyond an uppermost portion of the first pair of rails.

* * * * *